United States Patent [19]

Fruchey et al.

[11] Patent Number: 4,533,052

[45] Date of Patent: Aug. 6, 1985

[54] DUAL CARTON

[75] Inventors: Melvin C. Fruchey; Michael J. Kubicki, both of Toledo, Ohio

[73] Assignee: Owens-Illinois, Inc., Toledo, Ohio

[21] Appl. No.: 583,556

[22] Filed: Feb. 27, 1984

[51] Int. Cl.[3] ..... B65D 5/34

[52] U.S. Cl. ..... 206/602; 206/805

[58] Field of Search ..... 206/602, 192, 497, 805

[56] References Cited

U.S. PATENT DOCUMENTS

| | | | |
|---|---|---|---|
| 1,767,629 | 6/1930 | Walter | 206/602 |
| 2,684,178 | 7/1954 | Keeler | 206/602 |
| 2,709,519 | 5/1955 | Cushman | 206/602 |
| 2,710,130 | 6/1955 | Grecco | 206/602 |
| 2,787,409 | 4/1957 | Vogt | 206/602 |
| 3,087,666 | 4/1963 | Kitchell | 206/602 |
| 3,142,378 | 7/1964 | Lengsfield, Jr. | 206/602 |
| 3,331,105 | 7/1967 | Gordon | 206/497 |
| 3,447,733 | 6/1969 | Smith et al. | 206/602 |
| 3,540,582 | 11/1970 | Wood et al. | 206/602 |
| 3,759,378 | 9/1973 | Werth | 206/602 |
| 3,930,578 | 1/1976 | Stein | 206/805 |
| 3,993,191 | 11/1976 | Membrino | 206/602 |

FOREIGN PATENT DOCUMENTS

| | | | |
|---|---|---|---|
| 382645 | 12/1964 | Switzerland | 206/602 |

*Primary Examiner*—Stephen P. Garbe
*Attorney, Agent, or Firm*—John R. Nelson

[57] ABSTRACT

A dual carton for holding separate quantities of articles, such as bottles, jars or cans. A pair of open-topped cartons, which may be of the same or different sizes, are assembled with a vertical wall of each in abutting relationship and held in this position by a shrink band extending around the assemblage, adhesive tapes connecting the two cartons or glue spots between the two cartons adjacent the bottom one-third of the carton height. A one-piece cover or cap fits over both cartons and is provided with side flaps that are glued to the carton side walls. Handholes are provided in the cartons and/or the cap flaps adjacent the top edges. The cap is provided with a slit or tear strip across the middle above the abutting sides of the cartons.

4 Claims, 4 Drawing Figures

DUAL CARTON

BACKGROUND OF THE INVENTION

The present invention is directed to a multiple article package, such as a paperboard carton for enclosing a plurality of beverage containers. The package of the invention is in the form of a pair of open-topped, four-sided cartons, each adapted to hold an array of glass or plastic bottles or cans with a common cap overlying the two cartons. The cartons are held together by the cap and a separable means so that the cartons can be separated when being marketed or sold as a single unit.

It has been the practice in the past to sell a plurality of bottles, such as beer or beverage bottles, in convenience packs of six, eight, twelve and twenty-four. The usual case is a pack of 24 bottles. The cases have been made of corrugated board and chipboard, while the smaller units, such as 6-packs, are usually made of wrap-around paperboard that has interlocking tabs and flaps at the bottom of the unit. The present design is of a case size unit that is easily separated into a pair of twelve-pack units.

SUMMARY OF THE INVENTION

A multiple article container transporting package in which a pair of open-topped, four-sided cartons are positioned in abutting side-by-side relationship. Each carton is capable of holding a plurality of articles. Easily severable means are provided for holding the cartons together, and a covering cap is applied over both cartons with the covering cap being easily divided to retain its cover portion over each carton when they are separated.

DETAILED DESCRIPTION OF THE DRAWINGS

Figure 1:
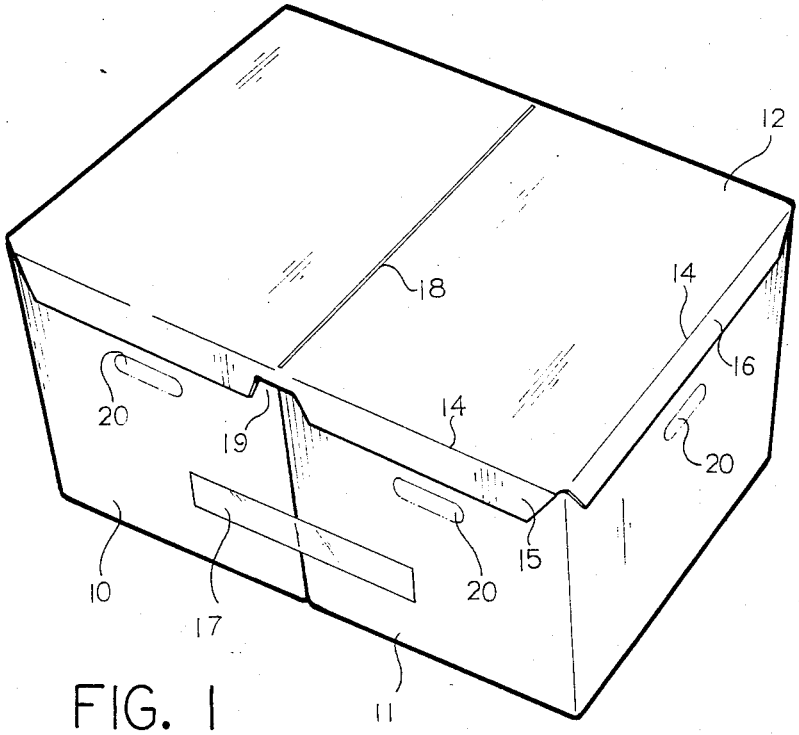
FIG. 1 is a perspective view of the first embodiment of a dual carton of the invention in its assembled form.
Figure 2:
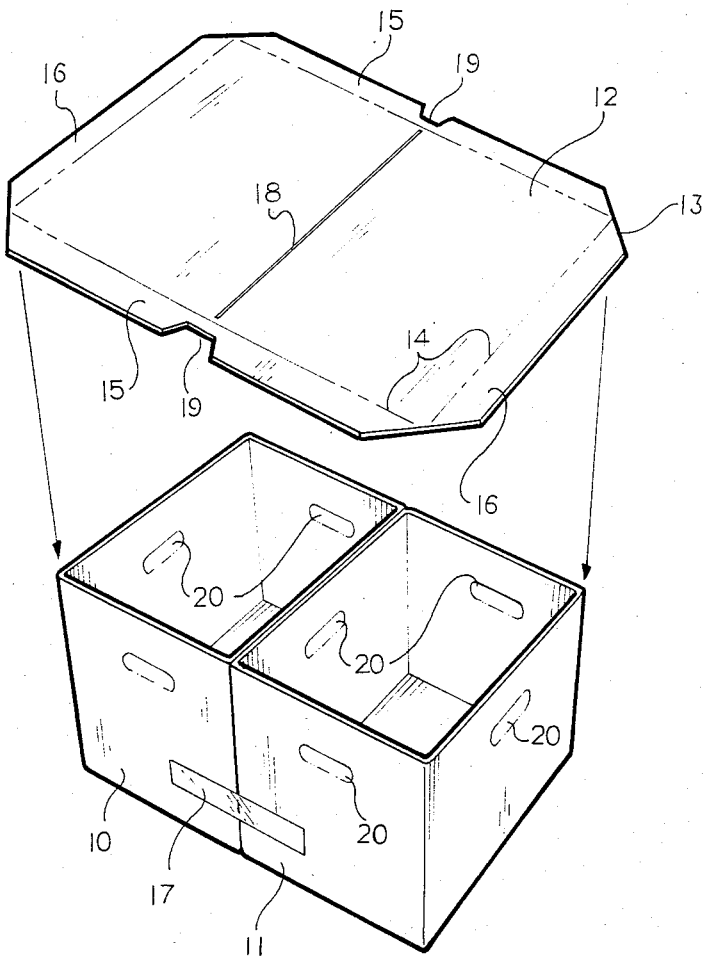
FIG. 2 is a perspective view of the dual carton of FIG. 1 with the cap held thereabove.

With particular reference to FIGS. 1 and 2, the preferred embodiment of the invention will be described.

A pair of open-topped corrugated cartons 10 and 11 are placed in juxtaposed position. A cover or cap 12 for the cartons 10 and 11 is formed of a single sheet of corrugated paperboard. The cap 12 is generally rectangular in shape with its corners cut at 45° angles with respect to the ends and sides thereof as shown at 13. The cap 12 has a rectangular scoreline 14 extending parallel to the edges of the cap. The scoreline 14 describes a rectangle of approximately the same size as the rectangle formed by the open tops of the juxtaposed cartons 10 and 11. As can be seen from FIG. 1, the cap 12 has its side and end areas capable of being folded down into flaps 15 and 16 as shown in FIG. 1. These flaps 15 and 16, when the cap is assembled to the cartons 10 and 11, will be adhesively attached to sides of the cartons 10 and 11.

The cartons 10 and 11 are held in their juxtaposed position by, for example, strips of adhesive tape 17.

While in the embodiment shown in FIGS. 1 and 2 there is a single piece of tape 17 visible, it should be kept in mind that a similar piece of tape will be applied on the opposite ends of the cartons to maintain them in a juxtaposed position. While the tape is shown as one example, it should be apparent that other means, such as small glue spots between the adjacent walls of the cartons 10 and 11 respectively, will maintain the two cartons in the position shown in FIG. 1. As a further alternative to the means for maintaining the two cartons in juxtaposed position, would be that shown in FIGS. 3 and 4, which will be described in greater detail. This embodiment shows a band that extends about the circumference of the assembled cartons.

In addition to the flaps 15 and 16, which in operative position are extending downward along the sides of the cartons 10 and 11, the cap 12 is formed with a transverse slit 18 in the top thereof in overlying relationship with respect to the plane of the adjacent sides of the two cartons 10 and 11. The opposed flaps 15 that extend along the sides of the cap 12 are formed with inwardly extending notches 19. These notches 19 are in alignment with the end of the slit 18, thus the cap 12, when applied to the cartons as shown in FIG. 1, will present a fairly narrow strip of material between the notch and the end of the slit 18. When the carton of the invention is used, it is capable of being divided into two independent carry-out cartons 10 and 11. All that is necessary to split the two cartons into a pair of dependent bottle or can carrying containers is to have the tapes 17 slit and the top or cap 12 severed at the notches 19. In this way the two cartons 10 and 11 may be marketed separately in the event the customer wants less than, for example, a full case of beverage containers. While the composite carton shown in FIGS. 1 and 2 would, for example, each hold a dozen beer containers and the two assembled cartons would then hold a full 24 container case, it is capable of being marketed as a full case or separated into half cases. For the convenience of the purchaser, the cartons 10 and 11 are provided with handholes 20 in all four walls of the cartons as they are produced, it being understood that the cartons then may be handled either from the ends as a full case or from the sides as half cases of beverage containers.

While the two cartons are depicted in FIGS. 1 and 2 as being of the same rectangular size, it should be apparent that they do not necessarily need to be such, only that the adjacent walls of the two cartons be of a similar size. However, it would be feasible to have, for example, the carton 10 capable of holding eight containers while the carton 11 could be made to hold sixteen containers, thus giving the overall capacity to the cartons of a full case, yet providing a system where the cartons could be divided and eight containers sold in one carton while sixteen could be sold in the other carton. Obviously, any combination of carton sizes would be feasible, and in each case the cap obviously would correspond in respect to its slit line 18 to the adjoining edges of the respective cartons that it is to cover. It should be also pointed out that with the flaps 15 and 16 bent down and secured to the walls of the cartons 10 and 11 that the bottom edges of these flaps help to strengthen the handholes 20, since the upper edge of the handholes 20 may be formed at or adjacent to the bottom edge of the flaps.

Figure 3:
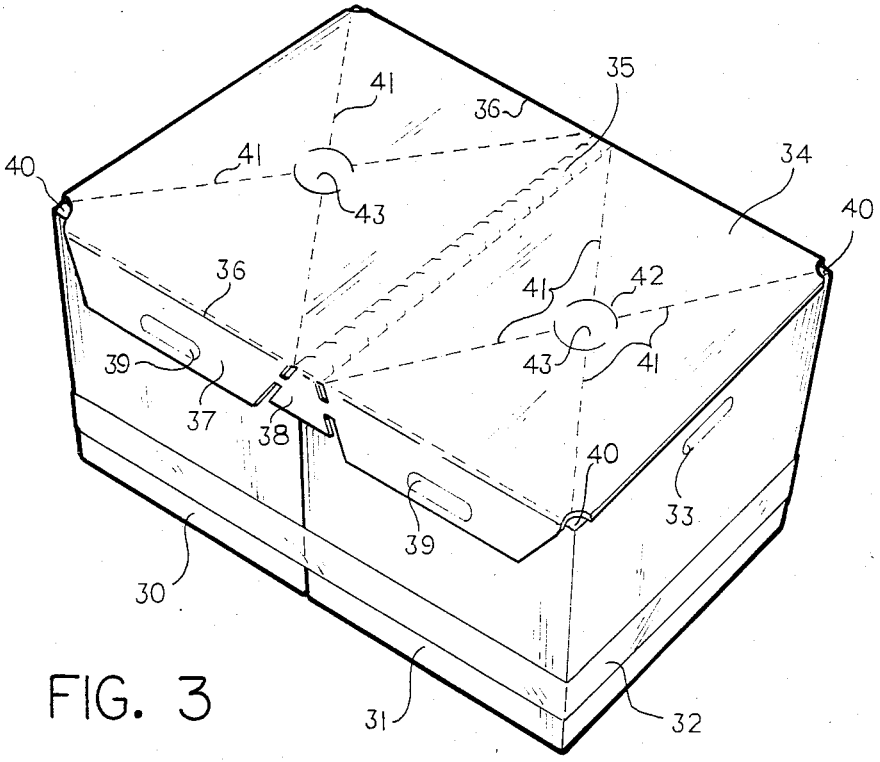
FIG. 3 is a perspective view of a second embodiment of the invention.
Figure 4:
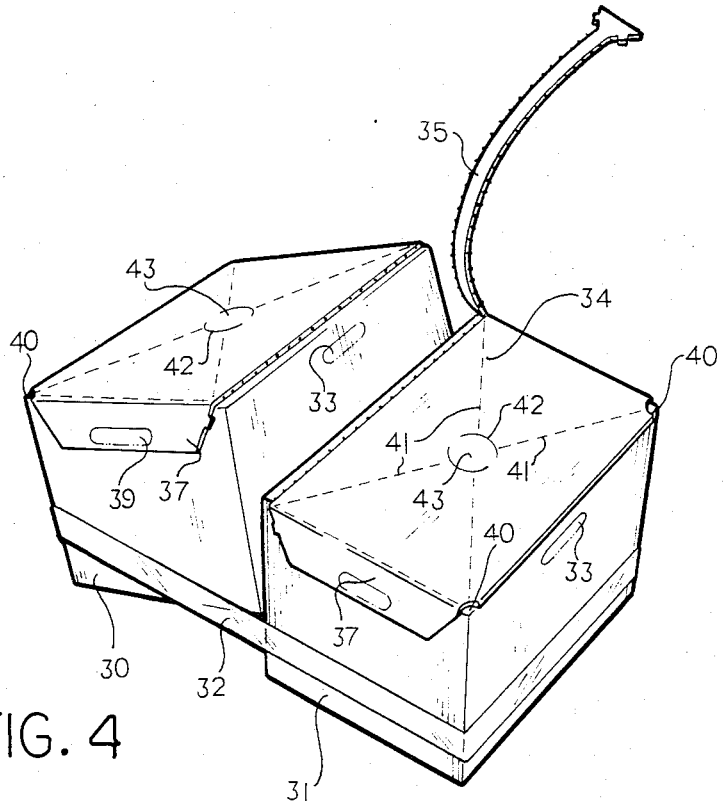
FIG. 4 is a perspective view of the dual carton of FIG. 3 in the process of being separated into separate cartons.

Turning now to the embodiment shown in FIGS. 3 and 4, it can be seen that again a pair of cartons 30 and 31 are positioned in adjacent juxtaposed relationship. The two cartons 30 and 31 are held in abutting relationship by, for example, a transparent endless tape 32, which may be formed as a band and then stretched to extend over both of the cartons and then contract to hold the two cartons in the position shown in FIG. 3. Alternatively, the band could be a heat-shrink band and after application could be subjected to a small amount of heat to contract the band into the position shown in FIG. 3.

In this embodiment the cartons again are provided with handholes 33. The two assembled cartons 30 and 31 are closed by a cap or cover 34. The cover 34 is provided with a slitted tear strip 35 extending across the width of the cap and positioned such as to overlie the adjoining vertical walls of the two cartons. The cover 34 is formed along both side edges with scorelines 36. Thus the cap 34 with the edges folded down about the scoreline 36 will form downwardly extending flaps 37. At the end of the tear strip 35, the flap 37 is perforated to form a finger grasping tab 38 which is integral with the tear strip 35. The flap 37 will, when assembled to a pair of cartons, be adhesively secured to the underlying sides of the cartons. The flaps 37 also are provided with handholes 39 therein which overlie the handholes 33 formed in the walls of the cartons. It should be noted that the cap in this embodiment of FIGS. 3 and 4 only has flaps 37 at opposed sides where the tear strip ends and that at the opposite ends of the assembled cartons there are no downward extending flaps connected to the cap as is the case in FIGS. 1 and 2, although these could be applied and could function similarly as in the embodiment of FIGS. 1 and 2. In addition to the flaps which effectively seal the cap or cover to the cartons, the covers are provided at their outside corners with hemispherical coutouts 40. These cutouts 40 in a sense expose the corners of the cartons and provide surfaces through which a set of scorelines 41 and 42 may extend. These scorelines 41 and 42 extend from adjacent the center of each half of the cap or cover 34 with the center of the cap at the two positions above the two cartons being provided with incompletely diecut circles 42. The incomplete circle 42 defines a knockout tab 43.

As in the embodiments of FIGS. 1 and 2, the embodiment shown here in FIGS. 3 and 4 may be marketed as a complete case or may be easily and simply divided into two carrying cases or cartons. In this embodiment of FIGS. 3 and 4, it is only necessary to grasp the tab 38 and remove the tear strip 35 to sever the cap or cover into separate covers for the two cartons. Then by lifting, for example, the carton 30 as shown in FIG. 4, it may be easily removed and carried away as a separate transportable package.

It also should be noted that in this embodiment the flaps 37 extend down over the handholes 33 in the end walls of the cartons 30 and 31 and by providing the handholes through these flaps 37 a reinforced, handhole carrying arrangement is provided for the individual cartons 30 and 31 when being transported individually.

The knockout tab 43 is provided in the cover such that for either carton when the contents thereof are being accessed, it is only necessary for the consumer to knock out the tab 43 and then pull toward any side and in effect the one quarter of the cover will be severed along the scorelines 41 to provide access to approximately one-fourth of the contents within the carton. Obviously, pulling of any of the quadrants remaining will permit access to the rest of the contents within either of the cartons 30 or 31. Again, in this embodiment the band 32 illustrates one way of maintaining the lower portion of the two juxtaposed cartons 30 and 31 in position as a single unit. However, it would be obvious that the means shown specifically in FIGS. 1 and 2 would likewise be compatible to the embodiment of 3 and 4, and further, the modification previously described of putting glue spots on adjacent walls of the two cartons, where the glue spots are sufficient to hold the cartons together in assembled position but may be, with a certain amount of force separated, is another possible way of maintaining the cartons together.

A further means of holding the lower portions of the cartons in juxtaposed position would be the use of a sheet similar to the cap used on top with a suitable slit or tear strip.

While the tape used in FIGS. 1 and 2 is shown as being stuck to the sides of the carton, obviously a single or pair of tapes could be likewise applied across the bottom of both cartons to effect the easily severable means for holding the cartons together in initially assembled position.

Other and further modifications may be apparent to those skilled in the art from the reading of the foregoing description of the two specific embodiments shown and described.

We claim:

1. A multiple article package comprising, a first open-topped, four-sided carton with fully closed bottom, for holding a first array of articles, a second open-topped, four-sided carton for holding a second array of articles, said cartons being in abutting relationship, means adjacent the top of at least all of the non-abutting sides of both cartons for providing dual handgrips for each carton, easily severable means holding said open-topped cartons together with the abutting sides deining a vertical plane, a generally rectangular cap covering both open-topped cartons and attached thereto and wherein said cap is formed with means extending across the portion thereof overlying the abutment plane of said cartons for easy separation of the cap when separation of the package into two cartons is affected.

2. The package of claim 1 wherein said means for easy separation of said cap comprises a tear strip.

3. The package of claim 1 wherein said means for easy separation of said cap comprises slit scores in said cap extending across the portion of said cap that overlies the abutment plane.

4. A multiple article package comprising, a first open-topped, four-sided carton with fully closed bottom, for holding a first array of articles, a second open-topped, four-sided carton for holding a second array of articles, said cartons being in abutting relationship, means adjacent the top of at least all of the non-abutting sides of both cartons for providing dual handgrips for each carton, and easily severable means holding said open-topped cartons together with the abutting sides defining a vertical plane, a generally rectangular cap covering both open-topped cartons, said cap formed with downwardly extending flanges along the sides thereof attached to the carton sides and formed with a slit extending across the portion thereof overlying the abutment plane with a narrow integral strip in said downwardly extending flanges at either end of said slit, whereby upon separation of the package into individual cartons will sever the strips of the cap as well, leaving the individual cartons with half of the full cap thereon.

* * * * *

UNITED STATES PATENT AND TRADEMARK OFFICE

CERTIFICATE OF CORRECTION

PATENT NO. : 4,533,052

DATED : Aug. 6, 1985

INVENTOR(S) : Melvin C. Fruchey, Michael J. Kubicki

It is certified that error appears in the above-identified patent and that said Letters Patent are hereby corrected as shown below:

Claim 1, Col. 4, line 36, "deining" should be --defining--.

Signed and Sealed this

*Twenty-sixth* Day of *November 1985*

[SEAL]

*Attest:*

DONALD J. QUIGG

*Attesting Officer*

*Commissioner of Patents and Trademarks*